US006413331B1

(12) United States Patent
Hurd et al.

(10) Patent No.: US 6,413,331 B1
(45) Date of Patent: Jul. 2, 2002

(54) ALUMINIUM ALLOY FOR USE IN A BRAZED ASSEMBLY

(75) Inventors: Timothy John Hurd, Askersloot; Nicolaas Dirk Adrianus Kooij, Nieuwegein, both of (NL); Achim Bürger, Hoehr-Grenzhausen; Klaus Vieregge, Neuweid, both of (DE)

(73) Assignee: Corus Aluminium Walzprodukte GmbH, Koblenz (DE)

( * ) Notice: Subject to any disclaimer, the term of this patent is extended or adjusted under 35 U.S.C. 154(b) by 0 days.

(21) Appl. No.: 09/646,547

(22) PCT Filed: Mar. 18, 1999

(86) PCT No.: PCT/EP99/01825

§ 371 (c)(1),
(2), (4) Date: Nov. 9, 2000

(87) PCT Pub. No.: WO99/55925

PCT Pub. Date: Nov. 4, 1999

(30) Foreign Application Priority Data

Apr. 29, 1998 (EP) ..... 98201393
Jul. 21, 1998 (EP) ..... 98202448

(51) Int. Cl.[7] ..... C22C 21/16; C22F 1/057
(52) U.S. Cl. ..... 148/528; 148/535; 228/262.51
(58) Field of Search ..... 148/528, 535; 228/262.51

(56) References Cited

U.S. PATENT DOCUMENTS

| | | | | |
|---|---|---|---|---|
| 4,214,925 A | | 7/1980 | Arita et al. | 148/528 |
| 4,626,295 A | * | 12/1986 | Sasaki et al. | 148/528 |
| 6,294,272 B2 | * | 9/2001 | Sontgerath et al. | 428/654 |

FOREIGN PATENT DOCUMENTS

| | | |
|---|---|---|
| EP | 0537764 | 4/1993 |
| EP | 0718072 | 6/1996 |
| JP | 63/123561 | 5/1988 |
| JP | 2/147163 | 6/1990 |
| JP | 003/8569 | 1/1991 |
| NL | 1004415 | 5/1998 |
| WO | 9422633 | 10/1994 |
| WO | 98/20178 | 5/1998 |

OTHER PUBLICATIONS

ASTM G–85, "Standard Practice for Modified Salt Spray (Fog) Testing", Designation: G 85, 1985 (Reapproved 1990).

* cited by examiner

*Primary Examiner*—George Wyszomierski
(74) *Attorney, Agent, or Firm*—Stevens, Davis, Miller & Mosher, LLP

(57) ABSTRACT

Aluminum alloy in the form of a sheet, plate or extrusion, having a composition in the range (in weight %):

| | |
|---|---|
| Si | <0.15 |
| Mn | 0.7–1.5 |
| Mg | up to 0.8 |
| Cu | 0.5–1.5 |
| Fe | <0.4 |
| Cr | <0.30 |
| Ti | <0.30 |
| V | <0.30 |
| Zr | <0.30 |
| others | each < 0.05<br>total < 0.15 |
| balance | aluminium |

and said aluminum alloy is provided in an aged condition.

23 Claims, No Drawings

ALUMINIUM ALLOY FOR USE IN A BRAZED ASSEMBLY

FIELD OF THE INVENTION

This invention relates to an aluminum alloy for use in a brazed assembly as a core material in brazing sheet, to the use of the aluminum alloy as core material of a brazing sheet in a brazed assembly, to the use of the aluminum alloy as fin stock material, to a method for manufacturing a brazed assembly, as well as to an assembly thus manufactured. The aluminum alloy is of the Aluminum Association 3xxx-type. Herein the term sheet material includes tube material, plate material and header material.

DESCRIPTION OF THE PRIOR ART

A principle use of brazing sheet containing such alloy is in heat exchangers, such as radiators, condensers and oil coolers. These heat exchangers are exposed to a severe external corrosive attack by e.g. deicing road salt. For that reason a good corrosion resistance is an essential property. Long-life alloys are considered herein as those which in the Sea Water Acidified Accelerated Test (SWAAT) without perforations according to ASTM G-85 exceed 10–12 days (see K. Scholin et al., VTMS 1993, SAE P-263). A further important property of the brazing sheet is the strength after brazing, hereafter referred to as the post-brazed strength.

WO 94/22633 describes such an alloy, having the composition, in weight %:

| | |
|---|---|
| Mn | 0.7–1.5 |
| Cu | 0.5–1.0, preferably > 0.6–0.9 |
| Fe | not more than 0.4 |
| Si | not more than 0.15 |
| Mg | up to 0.8 |
| V and/or Cr | up to 0.3, preferably up to 0.2 |
| Ti | up to 0.1 |

balance aluminum and impurities.

This alloy is used as core material with brazing clad layers containing Si. The high Cu content is to improve post-brazed strength. Ti is preferably not deliberately added, though is typically present from source material. Preferably Zr is not deliberately added. Cr and/or V are said not to improve post-brazed corrosion resistance, but contribute to post-brazed strength and sag resistance. The brazing sheet of WO 94/22633 has a reported post-brazed yield strength in the range of 54–85 MPa.

EP-A-0718072 discloses a brazing sheet having a core sheet made of an aluminum alloy core material and on at least one side thereof a brazing layer of an aluminum alloy containing silicon as main alloying element, wherein the aluminum alloy of the core sheet has the composition (in weight %):

| | |
|---|---|
| Mn | 0.7–1.5 |
| Cu | 0.2–2.0 |
| Mg | 0.1–0.6 |
| Si | >0.15, preferably > 0.20, and most preferably > 0.40 |
| Fe | up to 0.8 |
| Ti | optional, up to 0.15 |
| Cr | optional, up to 0.35 |
| Zr | and/or V optional, up to 0.25 in total |

balance aluminum and unavoidable impurities, and with the proviso that (Cu+Mg)>0.7.

The disclosed core alloy has a Si-level of more than 0.15%, and most preferably of more than 0.40%, in order to achieve the desired strength levels while maintaining a good corrosion resistance.

EP-A-0537764 discloses a method of producing aluminum alloy heat-exchanger in which a brazed assembly after brazing is cooled and then reheated for 10 minutes to 30 hours at a temperature in the range of 400 to 500° C. This additional heat treatment after brazing is in order to deposit elements (e.g. Si, Mg and Mn) which are brought into solid solution during the brazing cycle, and is said to improve the thermal conductivity of the material and thereby improving the thermal efficiency of the heat-exchanger obtained by about 3%. The core alloy used comprises not more than 0.5% of Cu and further comprises Si as an alloying element in the range of 0.05 to 1.0%.

U.S. Pat, No. 4,214,925 discloses a method for fabricating a brazed aluminum fin heat exchanger, in which the fins have a composition comprising 0.15 to 0.40 weight % of Cu, and is preferably of the heat-treatable AA6951 alloy, and in which the core sheet material of the brazing sheet is of the conventional AA3003 alloy. The cooling rate after solution heat-treatment for 30 minutes to 4 hours at 500 to 570° C., is in the range of 2.8 to 50° C./min, preferably 2.8 to 20° C./min, and more preferably about 10° C./min.

The later published international patent application no. PCT/EP97/06070 mentions a non-heat treatable aluminum alloy as core alloy in brazing sheet, i.e. it does not require post-brazing ageing treatment. Said aluminum core alloy, consisting of, in weight %:

| | |
|---|---|
| Mn | 0.7–1.5 |
| Cu | 0.6–1.0 |
| Fe | not more than 0.4 |
| Si | less than 0.1 |
| Mg | 0.05–0.8 |
| Ti | 0.02–0.3 |
| Cr | 0.1–0.35 |
| Zr | 0.1–0.2 |

balance aluminum and unavoidable impurities, and wherein $0.20 \leqq (Cr+Zr) \leqq 0.4$.

SUMMARY OF THE INVENTION

An object of the invention is to provide an aluminum alloy for use in a brazed assembly, in particular as core alloy in brazing sheet or as fin stock material, providing improved strength properties in combination with good corrosion resistance.

According to the invention, there is provided an aluminum alloy in the form of a sheet, plate or extrusion, having a composition in the range (in weight %):

| | |
|---|---|
| Si | <0.15 |
| Mn | 0.7–1.5 |
| Mg | up to 0.8 |
| Cu | 0.5–1.5 |
| Fe | <0.4 |
| Cr | <0.30 |
| Zr | <0.30 |
| Ti | <0.30 |
| V | <0.30 |
| others | each < 0.05, total < 0.15 |
| balance | aluminum |

and said aluminum alloy is provided in an aged condition.

In accordance with the invention it has surprisingly been found that the aluminum alloy appears to be age hardenable in the post-brazed condition, both by means of natural ageing and by artificial ageing. This ageing effect after brazing was yet undiscovered and is untypical for standard AA3xxx type alloys. It gives the possibility of a significant increase of the obtainable post-brazed yield strength in a range of 5 to 35 MPa over the post-brazed yield strength reported in the prior art, while the good corrosion resistance remains unchanged after the ageing treatment.

According to the invention the aluminum alloy is capable of providing a 0.2% yield strength of at least 75 MPa after brazing and ageing, and has a corrosion resistance of 13 days or more in SWAAT without perforations in accordance with ASTM G-85.

In a more preferred embodiment the aluminum alloy is capable of providing a 0.2% yield strength of at least 80 MPa after brazing and ageing, and more preferably of at least 85 MPa after brazing and ageing.

In the best examples, this corrosion resistance is more then 20 days. This level of corrosion resistance qualifies the alloy as a long-life product. Further, in the best examples, the provided 0.2% yield strength after brazing and the ageing is at least 95 MPa. Typically, but not by means of limitation, brazing is performed at about 590 to 600° C. for 3 to 5 min.

The aluminum alloy is of the AA3xxx type, Mn being the main alloying element in order to obtain the desired strength level. At least 0.7% is required for obtaining the desired strength, while a Mn content of over 1.5% does not produce any significant improvements in respect strength because coarse Al—Mn-containing particles are formed. A further disadvantage of coarse Al—Mn-containing particles is that they reduce the rollability of the aluminum alloy. More preferably the Mn content is in a range of 0.8 to 1.2%.

Magnesium is used in core alloys for brazing sheet to improve strength in vacuum brazed products. If a flux brazing process is applied, the Mg content is preferably kept at a low level, and preferably lower than 0.4%. In a further embodiment a Mg content of zero is preferred in flux brazing processes in which the brazability is improved. The Mg content is specified as up to 0.8% maximum and preferably 0.5% maximum.

The Si content in the aluminum alloy of this invention should be less than 0.15% in order to obtain long-life corrosion performance, and is preferably less than 0.10%. In an even more preferred range the Si is present at impurity level. Despite the low Si content a significant ageing effect is observed.

The Cu content in the aluminum alloy increases the strength of the alloy and should be in the range of 0.5 to 1.5%, and is preferably larger than 0.7%. In particular in this range in combination with a low Si content and in combination with Mg, the unexpected ageing effect has been observed, while the desired long-life corrosion resistance does not decrease significantly. With a Cu content of over 1.5% undesired coarse Cu-containing particles can be formed, as well as low melting phases. Preferably the Cu content is not more than 1.2%. The appearance of the strong ageing effect at the relative dilute levels of Cu and MNg is regarded as unexpected.

Fe is present in all known commercial aluminum alloys but in the aluminum alloys in accordance with this invention it is not a required alloying element and is not deliberately added. With a high Fe content among other things the corrosion resistance decreases. The admissible Fe content is 0.4% maximum and preferably 0.25% maximum.

Zinc may be included, preferably in a range of 0.0 to 2.0%, so that it remains in solid solution and helps to lower the corrosion rate.

In an embodiment the aluminum alloy in accordance with the invention contains at least one element selected from the group consisting of from 0.05 to 0.30% of Cr, from 0.05 to 0.30% Ti, from 0.05 to 0.30% of Zr, and from 0.05 to 0.30% of V. The addition of at least one of the above mentioned elements results in at least a further improvement of the post-braze strength level after the ageing treatment. At contents above 0.25% of the individual elements undesired coarse particles can be formed.

The total amount of the optional additions of Cr, Ti, Zr, and V is chosen such that $0.05<(Cr+Ti+Zr+V)<0.4$.

In another embodiment of the invention at least Zr is present in a range of $0.05<Zr<0.25\%$, and more preferably in a range of $0.05<Zr<0.15\%$. It has been found that Zr in particular improves the ageing response of the aluminum alloy and results in significant increases of the post-brazed and aged strength levels. In the best examples the yield strength after brazing and ageing is at least 95 MPa, which is an achievement over the post-brazed yield strength reported in the prior art.

In another preferred embodiment of the invention the aluminum alloy has a composition as mentioned in the international patent application no. PCT/EP97/06070, which is included here by reference. The composition of this aluminum alloy is (in weight %):

| | |
|---|---|
| Mn | 0.7–1.5 |
| Cu | 0.6–1.0 |
| Fe | not more than 0.4 |
| Si | less than 0.1 |
| Mg | 0.05–0.8 |
| Ti | 0.02–0.3 |
| Cr | 0.1–0.25 |
| Zr | 0.1–0.2 |

balance aluminum and unavoidable impurities, and wherein $0.20<(Cr+Zr)<0.4$.

The invention also consists in brazing sheet comprising, as core material (i.e. strength providing material), the alloy of the invention described above. A clad or coating layer acting as a sacrificial anode in contact with water is not required, such a layer may be provided on one or both sides of the core alloy. On one side, in contact with the core alloy, there will normally be a clad layer in the form of a conventional low melting alloy filler layer.

The invention further consists in use of the aluminum alloy of the invention described above as core material of a brazing sheet in a brazed assembly. In such an assembly, the aluminum alloy core material may be directly in contact with the brazing alloy which is melted at the brazing temperature.

The invention further consists in use of the aluminum alloy of the invention described above as fin stock material in a brazed assembly.

Although they are particularly suitable for brazing purposes, the alloys of this invention are also capable of being extruded to yield corrosion resistant extruded sections.

The invention further consists in the use of an aluminum alloy having a composition (in weight %):

| | |
|---|---|
| Si | <0.15 |
| Mn | 0.7–1.5 |
| Mg | up to 0.8 |
| Cu | 0.5–1.5 |
| Fe | <0.4 |
| Cr | <0.30 |
| Zr | <0.30 |
| Ti | <0.30 |
| V | <0.30 |
| others | each < 0.05, total < 0.15 |
| balance | aluminum |

for subjecting to an ageing treatment after cooling from brazing where the cooling rate is at least in the range of typical brazing furnace cooling rates. Typical ageing treatments are natural ageing and artificial ageing. More preferred ranges for the alloying elements are set out above.

The invention also provides a method for manufacturing a brazed assembly using brazing sheet or fin stock material, comprising the steps of:

(i) forming parts of which at least one is made from the brazing sheet;

(ii) assembling the parts into the assembly;

(iii) brazing the assembly;

(iv) cooling the brazed assembly to below 100° C. with a cooling rate of at least 20° C./min;

(v) ageing the brazed and cooled assembly, and wherein the brazing sheet has a core made of an aluminum alloy having the composition (in weight %):

| | |
|---|---|
| Si | <0.15 |
| Mn | 0.7–1.5 |
| Mg | up to 0.8 |
| Cu | 0.5–1.5 |
| Fe | <0.4 |
| Cr | <0.30 |
| Zr | <0.30 |
| Ti | <0.30 |
| V | <0.30 |
| others | each < 0.05<br>total < 0.15 |
| balance | aluminum |

In accordance with this invention it has been found that the cooling rate after the brazing cycles plays an important role in obtaining the yet undiscovered ageing effect after brazing. More preferably the cooling rate after brazing is at least 40° C./min, and more preferably at least 60° C./min. Increasing the cooling rate after the brazing cycles can give rise to a further increase in the strength levels which can be obtained. The appearance of the strong ageing effect after brazing at the relative dilute levels of Cu and Mg is regarded as unexpected, in particular since the brazing cycle is relatively short and no water quench is applied.

Typically ageing processes for obtaining the desired level of yield strength are (i) natural ageing, and (ii) artificial ageing at a temperature in the range of 100 to 250° C. for a soaking time in a range of 5 to 1000 hours. The ageing treatment is discussed in more detail further below.

The invention also provides a brazed assembly comprising at least two members bonded together by means of a brazing alloy, at least one of the members being sheet material comprising the aluminum alloy of the invention described above as its core.

It should be mentioned here that in European patent application no. EP-A-0718072 a comparative example C7 is described containing in weight %: 1.1% Mn, 0.75% Cu, 0.5% Mg, 0.1% Si, balance essentially aluminum and impurities. In FIG. 1 of this publication it is shown that the alloy has an increase in 0.2% yield strength due to natural ageing after a simulated brazing cycle. However, in the description nothing is mentioned about the cooling rate after the simulated brazing cycle.

EXAMPLES

The invention will now be illustrated by several non-limitative examples.

The post-braze strength can be measured by conducting a simulated brazing cycle, as is conventional in the art. Since the core alone provides the tensile strength of the brazing sheet, this cycle may be carried out as the core alloy alone or on a sheet having core and clad layers. The simulated brazing cycle used here is heating in a furnace and holding at 590 to 595° C. for 4 minutes, followed by cooling.

Example 1

The following test was carried out on a laboratory scale. Ingots of 15 aluminum alloys for use as core alloys in brazing sheets were cast and solidified at a cooling rate comparable to those cooling rates that occur in DC-casting. Table 1 gives the chemical compositions of the alloys, in % by weight (balance Al and impurities) of the as-cast material. The ingots were pre-heated to 450° C. for 5 hours, with a heating rate of 30° C./h hot-rolled from an initial thickness of 100 mm to a thickness of 2.7 mm, and then cold-rolled to a final thickness of 0.38 mm, applying an interanneal at an intermediate gauge. The finished cold-rolled sheets were annealed to H24-temper and cooled to room temperature. Following annealing the sheets were subjected to the simulated brazing cycle and cooled to below 100° C. with different the cooling rates. Mechanical properties were assessed in accordance with NEN-EN 10 002-1 after natural ageing at room temperature and the results are given in Table 2.

The samples were subjected to SWAAT until first perforations appear according to ASTM G-85, and the average results in days are given in Table 3. For the cooling rate 60° C./min it is an average over 3 samples tested and for the cooling rates 20 and 90° C./min it is an average over 2 samples tested. The marker (–) indicates "not tested".

From the results of Table 2 it can be seen that there is a distinct natural ageing response for the indicated alloy type giving rise to a possible increase of the obtainable post-brazed yield strength in a range of 5 to 35 MPa over the post-braze yield strength directly after brazing. While from the results of Table 3 it can be seen that these alloys can be qualified as having long-life corrosion properties. When from Table 2 the results of the ingot numbers 10, 11, and 13 are compared it can be seen that the addition of Zr has a clear influence on the ageing response and gives rise to higher yield strengths. The addition of Cr in the given range results in an overall increase of the post-brazed yield strength. When the results of ingot numbers 12 and 15 are compared it can be seen that the ageing response is much more pronounced at higher Cu contents. Comparing the results of ingot numbers 4, 5, and 6 shows that with an increase in Cu-content the post-braze strength levels are increased and further that the ageing response is more pronounced at high Cu contents. Comparing the results of ingot numbers 4, 8, and 9 shows that an increase in Fe content results in higher post-brazed strength levels but decreases the corrosion life. Looking at the results after 35 days of natural ageing for a cooling rate of 20° C./min and 60° C./min, it can be seen that a higher cooling rate after brazing results in an overall increase in post-brazed yield strength.

Example 2

In another experiment on a laboratory scale of testing 5 ingots were produced in a similar way as in example 1 except the ingots were homogenised prior to hot-rolling for 10 hours at a temperature of 600° C. and had a heating and cooling rate of 30° C./h. The chemical compositions of the as-cast ingots are given in Table 4, and are identical to ingots numbers 1, 2, 3, 11, and 13 respectively. The 0.2% yield strength (in MPa) as function of natural ageing time at room temperature and cooling rate after the brazing cycle are given in Table 5.

From these results it can be seen that a homogenisation treatment does not deteriorate the ageing response of the alloy in accordance with this invention. It is known in the art that homogenisation of this type of alloys increases the formability of the final sheet product but decreases post-braze strength. Using the undiscovered ageing effect the advantage of increased formability can still be combined with an increase in post-brazed strength by applying an ageing treatment. By applying a homogenisation under controlled conditions the corrosion resistance is not sacrificed.

Example 3

In a further laboratory scale of testing 6 ingots from example 1 were tested for their artificial ageing response. Material from ingots no. 1, 4, 5, 7, 11 and 13 were processed in the same way as with Example 1 and after the brazing cycle cooled to below 100° C. with a cooling rate of 60° C./min. The ageing temperature was 165° C. Table 6 gives the hardness (Rockwell 15 T–15 kg) as function of the ageing time and also the 0.2% yield strength (in MPa). For comparison also the hardness after 5 days of natural ageing at room temperature is given.

From these results it can be seen that there is a distinct artificial ageing response for the indicated alloy type. In this particular example the results for natural ageing are in the same range as for artificial ageing. Also here the addition of Zr has a beneficial effect on the final strength level as can be seen from the comparison of ingot numbers 11 and 13. It is well within the range of the skilled person to further optimise the temperature-time ranges during artificial ageing in order to achieve further improvements of the strength of the alloy in the post-brazed condition.

TABLE 1

Chemical composition in weight. % of the as-cast ingots

| Ingot no. | Si | Mn | Cu | Mg | Fe | Cr | Zr | Ti |
|---|---|---|---|---|---|---|---|---|
| 1 | 0.06 | 0.77 | 0.86 | 0.30 | 0.21 | 0.15 | 0.096 | 0.03 |
| 2 | 0.11 | 1.00 | 1.01 | 0.40 | 0.23 | 0.15 | 0.104 | 0.03 |
| 3 | 0.10 | 0.90 | 0.80 | 0.27 | 0.19 | 0.14 | 0.110 | 0.03 |
| 4 | 0.08 | 0.91 | 0.96 | 0.37 | 0.24 | 0.15 | 0.092 | 0.03 |
| 5 | 0.08 | 0.90 | 0.87 | 0.36 | 0.23 | 0.15 | 0.105 | 0.03 |
| 6 | 0.08 | 0.90 | 1.01 | 0.36 | 0.23 | 0.15 | 0.107 | 0.03 |
| 7 | 0.08 | 0.90 | 0.94 | 0.52 | 0.22 | 0.15 | 0.107 | 0.03 |
| 8 | 0.08 | 0.90 | 0.94 | 0.36 | 0.42 | 0.14 | 0.104 | 0.03 |
| 9 | 0.08 | 0.88 | 0.97 | 0.37 | 0.11 | 0.14 | 0.106 | 0.03 |
| 10 | 0.07 | 1.01 | 0.94 | 0.36 | 0.22 | — | 0.062 | 0.03 |
| 11 | 0.08 | 0.89 | 0.94 | 0.36 | 0.22 | — | 0.109 | 0.03 |
| 12 | 0.07 | 0.94 | 0.60 | 0.35 | 0.08 | — | — | 0.03 |
| 13 | 0.08 | 1.00 | 0.95 | 0.37 | 0.22 | — | — | 0.03 |
| 14 | 0.10 | 0.96 | 0.84 | 0.30 | 0.20 | 0.15 | 0.098 | 0.03 |
| 15 | 0.07 | 0.98 | 0.93 | 0.35 | 0.10 | — | — | 0.03 |

TABLE 2

The 0.2% yield strength (in MPa) as function of natural ageing time (in days) and cooling rate (in ° C./min) after the brazing cycle

| | Cooling rate 20° C./min. | | Cooling rate 40° C./min | Cooling rate 60° C./min | | | | Cooling rate 90° C./min. | | | Cooling rate >90° C./min |
|---|---|---|---|---|---|---|---|---|---|---|---|
| Ingot no. | 5 days | 35 days | 35 days | 5 days | 20 days | 35 days | 50 days | 5 days | 35 days | 50 days | 35 days |
| 1 | 72 | 79 | — | 74 | 81 | 83 | 86 | — | 82 | 89 | — |
| 2 | 83 | 99 | 106 | 90 | 101 | 108 | 113 | — | 107 | 113 | — |
| 3 | 76 | 78 | 80 | 78 | 81 | 86 | 86 | — | 81 | 87 | — |
| 4 | 74 | 83 | 86 | 79 | 84 | 87 | 97 | — | 87 | 96 | — |
| 5 | 75 | 77 | 81 | 79 | 80 | 86 | 86 | — | 82 | 88 | — |
| 6 | 78 | 93 | — | 81 | 97 | 99 | 104 | — | 97 | 104 | — |
| 7 | 80 | 95 | 103 | 83 | 97 | 112 | 112 | — | 107 | 111 | — |
| 8 | 74 | 89 | 92 | 78 | 88 | 97 | 99 | — | 90 | 100 | — |
| 9 | 75 | 80 | 86 | 80 | 90 | 91 | 92 | — | 89 | 92 | 94 |
| 10 | 71 | 94 | 99 | 76 | 95 | 100 | 103 | 82 | 95 | — | 99 |
| 11 | 71 | 92 | 96 | 72 | 88 | 94 | 103 | 72 | 91 | — | 96 |
| 12 | | 61 | 61 | 62 | 66 | 62 | 64 | 62 | 63 | — | 61 |
| 13 | | 85 | 90 | 71 | 85 | 90 | 96 | 71 | 94 | — | 84 |
| 14 | | 78 | 80 | 77 | 82 | 85 | 85 | 81 | 86 | — | 86 |
| 15 | | 79 | — | 69 | 85 | 92 | 96 | 73 | 96 | — | 96 |

TABLE 3

Average SWAAT results (in days) in accordance with ASTM G-85.

| Ingot number | Cooling rate (° C./min) 20 | 60 | 90 | Average (days) |
|---|---|---|---|---|
| 1 | 25 | 31 | 23 | 27 |
| 2 | — | 13 | 13 | 13 |
| 4 | 19 | 23 | 25 | 23 |
| 7 | — | 17 | — | 17 |
| 8 | — | 18 | — | 18 |
| 9 | — | 22 | — | 22 |
| 11 | — | 24 | — | 24 |
| 12 | — | 28 | — | 28 |
| 13 | — | 29 | — | 29 |
| 15 | — | 33 | — | 33 |

TABLE 4

Chemical composition in weight. % of the as-cast ingots

| Ingot no. | Si | Mn | Cu | Mg | Fe | Cr | Zr | Ti |
|---|---|---|---|---|---|---|---|---|
| 16 | 0.06 | 0.77 | 0.86 | 0.30 | 0.21 | 0.15 | 0.096 | 0.03 |
| 17 | 0.11 | 1.00 | 1.01 | 0.40 | 0.23 | 0.15 | 0.104 | 0.03 |
| 18 | 0.10 | 0.90 | 0.80 | 0.27 | 0.19 | 0.14 | 0.110 | 0.03 |
| 19 | 0.08 | 0.89 | 0.94 | 0.36 | 0.22 | — | 0.109 | 0.03 |
| 20 | 0.08 | 1.00 | 0.95 | 0.37 | 0.22 | — | — | 0.03 |

What is claimed is:

1. A method for manufacturing a brazed assembly using brazing sheet, comprising the subsequent steps of:

(i) forming parts of which at least one is made from the brazing sheet;

(ii) assembling the parts into the assembly;

(iii) brazing the assembly;

(iv) cooling the brazed assembly to below 100° C. with a cooling rate of at least 40° C./min;

(v) ageing the brazed and cooled assembly to achieve an 0.2% yield strength of at least 85 MPa and a corrosion life of 13 days or more in a SWAAT-test without perforations in accordance with ASTM G-85, and wherein the brazing sheet has a core made of an aluminum alloy having the composition (in weight %):

| | |
|---|---|
| Si | <0.15 |
| Mn | 0.7–1.5 |
| Mg | up to 0.8 |
| Cu | 0.5–1.5 |
| Zn | <2.0 |
| Fe | <0.4 |
| Cr | <0.30 |
| Ti | <0.30 |
| Zr | <0.30 |
| V | <0.30 |
| others | each < 0.05 |
| | total < 0.15 |
| balance | aluminium. |

TABLE 5

The 0.2 % yield strength (in MPa) as function of natural ageing time (in days) and cooling rate (in ° C./min) after the brazing cycle

| Ingot no. | Cooling rate 20° C./min 35 days | Cooling rate 40° C./min 35 days | Cooling rate 60° C./min 5 days | 20 days | 35 days | 50 days | Cooling rate 90° C./min. 5 days | 35 days | Cooling rate >90° C./min 35 days |
|---|---|---|---|---|---|---|---|---|---|
| 16 | 72 | 79 | 64 | 71 | 76 | 86 | 67 | 81 | 81 |
| 17 | 95 | 103 | 75 | 101 | 101 | 104 | 78 | 104 | 107 |
| 18 | 87 | — | 71 | 91 | 91 | 96 | 72 | 88 | 94 |
| 19 | 89 | 93 | 64 | 79 | 92 | 93 | 67 | 92 | 90 |
| 20 | 92 | 90 | 65 | 82 | 94 | 94 | 67 | 93 | 92 |

TABLE 6

The hardness and 0.2% yield strength (in MPa) as FUNCTION of the ageing time at 165° C.

| Ingot no. | Hardness Rockwell: 5 days natural ageing | Hours of ageing 3 | 7 | 14 | 24 | 48 | 72 | 82 | 0.2% yield strength Hours of ageing 14 | 48 |
|---|---|---|---|---|---|---|---|---|---|---|
| 1 | 57.5 | 56.3 | 60.8 | 60.6 | 61.7 | 58.4 | 57.1 | 60.7 | 112 | 113 |
| 4 | 49.8 | 55 | 54.3 | 53.3 | 56.5 | 54.8 | 53.7 | 55.4 | 99 | 101 |
| 5 | 54.3 | 53.4 | 51.1 | 54.5 | 54.7 | 55.4 | 56.3 | 54.4 | 97 | 99 |
| 7 | 58.2 | 60.4 | 62.1 | 62.2 | 63.6 | 64.2 | 62.9 | 60.1 | 112 | 119 |
| 11 | 54.5 | 54.9 | 58.4 | 59.5 | 58.3 | 59.9 | 59 | 58.6 | 95 | 102 |
| 13 | 53.9 | 56 | 57.1 | 57.5 | 58 | 57.7 | 57.9 | 58.5 | 89 | 94 |

2. The method in accordance with claim 1, wherein said ageing comprises natural ageing.

3. The method in accordance with claim 2, wherein the aluminum core alloy has a Cu content of at least 0.7 wt. %.

4. The method in accordance with claim 2, wherein the aluminum core alloy has a Zr content in the range of 0.05 to 0.25 wt. %.

5. The method in accordance with claim 2, wherein the aluminum core alloy has a Mg content in the range of 0.05 to 0.8 wt. %.

6. The method in accordance with claim 2, wherein during step (iv) the brazed assembly is cooled to below 100° C. with a cooling rate of at least 60° C./min.

7. The method in accordance with claim 2, wherein during step (v) the brazed and cooled assembly is aged to achieve a 0.2% yield strength of at least 95 MPa.

8. The method in accordance with claim 1, wherein said ageing comprises artificial ageing at a temperature in the range of 100 to 250° C.

9. The method in accordance with claim 1, wherein the aluminum core alloy has a Cu content of at least 0.7 wt. %.

10. The method in accordance with claim 9, wherein the aluminum core alloy has a Zr content in the range of 0.05 to 0.25 wt. %.

11. The method in accordance with claim 10, wherein the aluminum core alloy has a Mg content in the range of 0.05 to 0.8 wt. %.

12. The method in accordance with claim 1, wherein the aluminum core alloy has a Zr content in the range of 0.05 to 0.25 wt. %.

13. The method in accordance with claim 1, wherein the aluminum core alloy has a Mg content in the range of 0.05 to 0.8 wt. %.

14. The method in accordance with claim 1, wherein during step (iv) the brazed assembly is cooled to below 100° C. with a cooling rate of at least 60° C./min.

15. The method in accordance with claim 1, wherein during step (v) the brazed and cooled assembly is aged to achieve a 0.2% yield strength of at least 95 MPa.

16. A method of using an aluminum alloy having a composition in the range (in weight %):

| | |
|---|---|
| Si | <0.15 |
| Mn | 0.7–1.5 |
| Mg | up to 0.8 |
| Cu | 0.5 to 1.5 |
| Zn | <2.0 |
| Fe | <0.4 |
| Cr | <0.30 |
| Ti | <0.30 |
| V | <0.30 |
| Zr | <0.30 |
| others | each < 0.05<br>total < 0.15 |
| balance | aluminum |

comprising the steps of:

forming a sheet of the alloy to be a core alloy;

cladding a cladding alloy on at least one side of the sheet of core alloy to form a brazing sheet; and subjecting said brazing sheet to the method of claim 1.

17. The method in accordance with claim 16, wherein said ageing comprises natural ageing.

18. The method in accordance with claim 16, wherein said ageing comprises artificial ageing at a temperature in the range of 100 to 250° C.

19. The method in accordance with claim 16, wherein during step (iv) the brazed assembly is cooled to below 100° C. with a cooling rate of at least 60° C./min.

20. The method in accordance with claim 16, wherein during step (v) the brazed and cooled assembly is aged to achieve a 0.2% yield strength of at least 95 MPa.

21. The method in accordance with claim 16, wherein the aluminum core alloy has a Mg content in the range of 0.05 to 0.8 wt. %.

22. The method in accordance with claim 16, wherein the aluminum core alloy has a Cu content in the range of 0.7 to 1.5 wt. %.

23. A method of using an aluminum alloy having a composition in the range (in weight %):

| | |
|---|---|
| Si | <0.15 |
| Mn | 0.7–1.5 |
| Mg | up to 0.8 |
| Cu | 0.5 to 1.5 |
| Zn | <2.0 |
| Fe | <0.4 |
| Cr | <0.30 |
| Ti | <0.30 |
| V | <0.30 |
| Zr | <0.30 |
| others | each < 0.05<br>total < 0.15 |
| balance | aluminum |

comprising the steps of:

forming a sheet of the alloy to be a core alloy;

cladding a cladding alloy on at least one side of the sheet of core alloy to form a brazing sheet; and (i) forming parts of which at least one is made from the brazing sheet;

(ii) assembling the parts into the assembly;

(iii) brazing the assembly;

(iv) cooling the brazed assembly;

(v) ageing the brazed and cooled assembly, wherein the aluminum alloy being capable of obtaining in the post-brazed and aged state 0.2% yield strength of at least 75 MPa and having a corrosion life of 13 days or more in a SWAAT-test without perforations in accordance with ASTM G-85.

* * * * *